United States Patent [19]

Poor

[11] Patent Number: 4,708,503

[45] Date of Patent: Nov. 24, 1987

[54] WORK CARRIER FOR USE IN COMPUTER PRINTING

[75] Inventor: David D. S. Poor, Meadowbrook, Pa.

[73] Assignee: Meadowbrook Industries, Inc., Pa.

[21] Appl. No.: 4,231

[22] Filed: Jan. 7, 1987

Related U.S. Application Data

[63] Continuation of Ser. No. 714,241, Mar. 21, 1985, abandoned, which is a continuation-in-part of Ser. No. 512,542, Jul. 11, 1983, abandoned.

[51] Int. Cl.[4] ..... B41J 13/12

[52] U.S. Cl. ..... 400/531; 270/52; 282/5; 283/66 R; 281/2; 400/622

[58] Field of Search ..... 400/531, 535, 522, 525, 400/619, 622, 581; 270/58, 52; 282/11.5 R, 11.5 A, 25, 5; 283/66 R; 281/2; 229/69 R; 40/158 A, 158 B, 124.4, 160

[56] References Cited

U.S. PATENT DOCUMENTS

| | | | |
|---|---|---|---|
| 1,378,709 | 5/1921 | Martin | 40/158 B |
| 1,474,174 | 11/1925 | Segall | 40/158 B |
| 1,544,139 | 6/1925 | Duclos | 40/158 B |
| 2,842,882 | 7/1958 | Greene et al. | 40/158 B |
| 3,214,083 | 10/1965 | Jory | 229/69 |
| 3,484,097 | 12/1969 | Jory | 270/52 |
| 4,636,099 | 1/1987 | Goldstone | 400/622 |

FOREIGN PATENT DOCUMENTS

| | | | |
|---|---|---|---|
| 2656918 | 6/1978 | Fed. Rep. of Germany | 40/158 B |
| 602352 | 12/1976 | Switzerland | 270/52 |
| 373887 | 6/1932 | United Kingdom | 40/124.4 |

OTHER PUBLICATIONS

"Continous Form With Insert Pocket", *IBM Technical Disclosure Bulletin,* vol. 2, No. 2, 8/59, p. 24.

*Primary Examiner*—E. H. Eickholt
*Attorney, Agent, or Firm*—Robert C. Podwil

[57] ABSTRACT

A carrier for work to be printed comprises a web made up of a series of panels, connected edge-to-edge, and providing means, such as slits, tabs and flaps for coupling the work to the web. The slits, tabs and flaps are preferably arranged to accommodate standard sizes of stationery, so that cut sheets of stationery, coupled to the web, may be printed automatically.

9 Claims, 7 Drawing Figures

FIG. 1
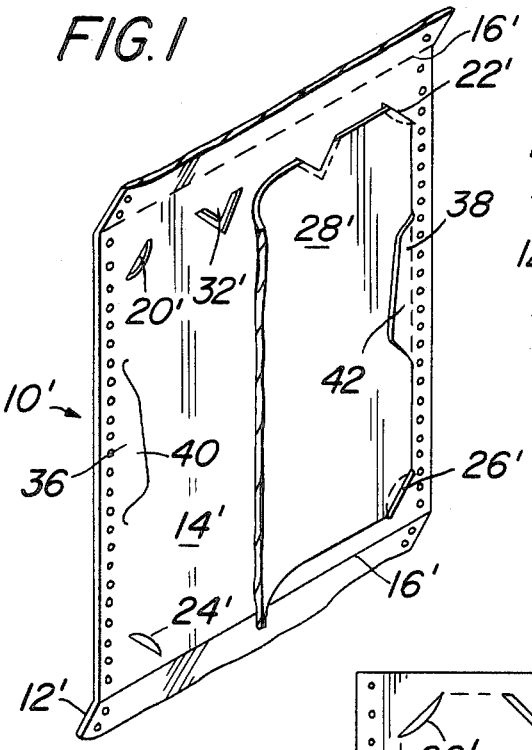
FIG. 5
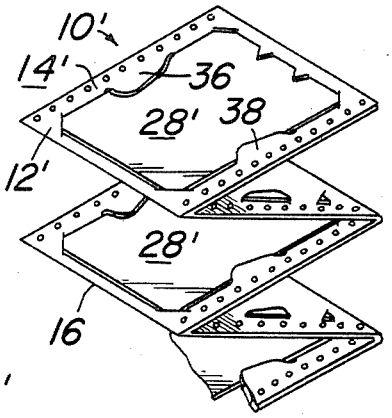
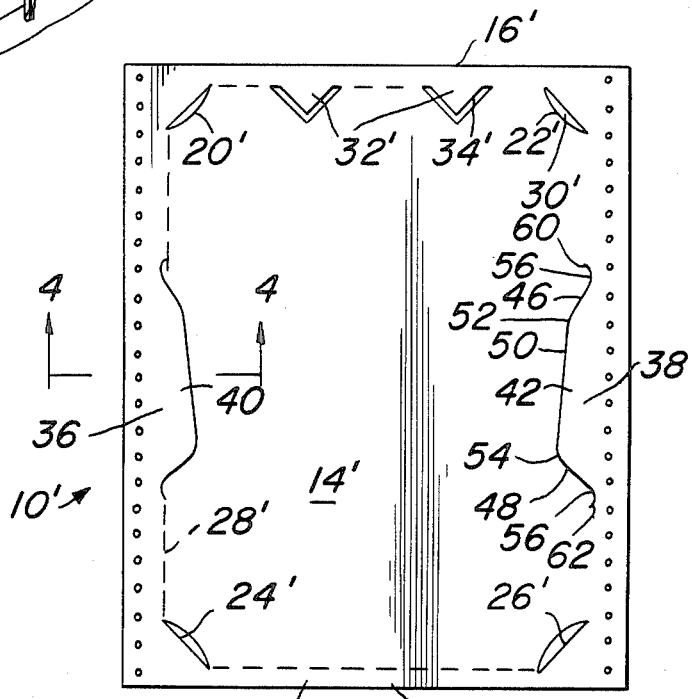
FIG. 3
FIG. 4
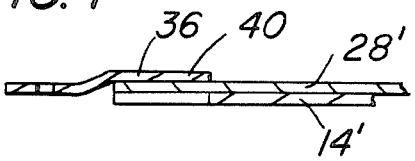

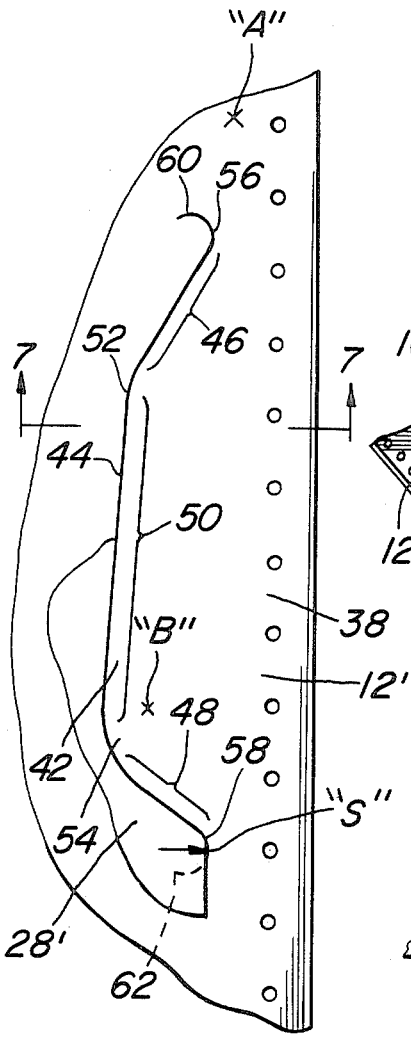
FIG.6
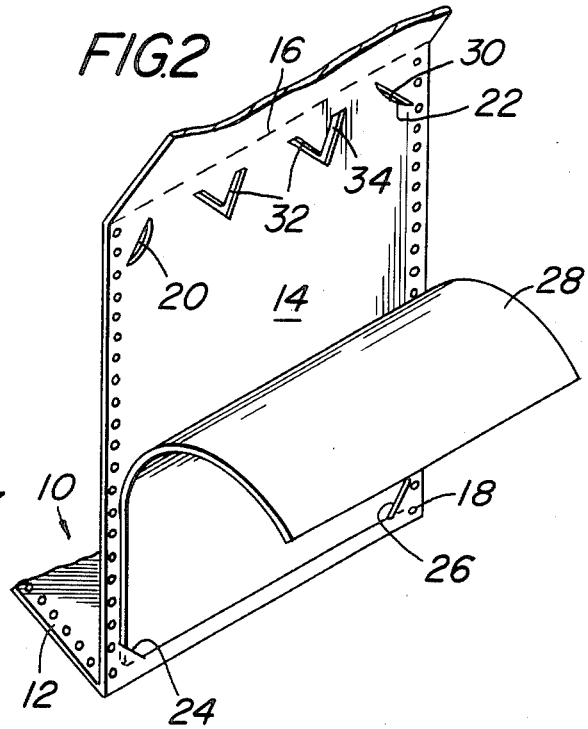
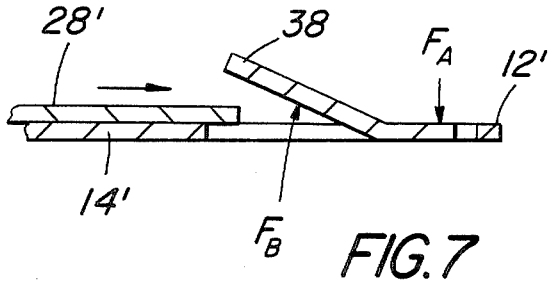
FIG.7

WORK CARRIER FOR USE IN COMPUTER PRINTING

CROSS-REFERENCE TO RELATED APPLICATION

This application is a continuation-in-part of my copending application Ser. No. 512,542, filed July 11, 1983, now abandoned.

BACKGROUND OF THE INVENTION

This invention relates to apparatus for use in computer printing, and more particularly, to a work carrier onto which ordinary stationery may be easily "loaded" for printing, and removed after printing, to yield a document with the appearance of a conventionally typed item.

With the general availability of small so-called "personal" or "micro" computers, it has become possible for individuals and small businesses to take advantage of the word processing capabilities of computers, and to generate large volumes of typed or printed correspondence. In many situations, it is desirable to generate a product which has the appearance of an individually typewritten item, not a preprinted "form" letter.

So-called cut-sheet feeders, operating in conjunction with computer printers, are capable of producing multiple letters on stationery, but the cost of such equipment makes it uneconomical for individuals and small businesses. Cut sheets and stationery have also been glued, or "tipped", to webs usually, the webs being discarded after printing and not designed for reuse.

In another presently used technique, prepared blank forms are provided as a continuous folded web, the edges of which contain tractor feed perforations, engageable by the drive sprockets of a printer to position and advance the web. The portions of the web which contain the perforations are separated from the main body of the web (which is the portion of the web intended for printing) by special score lines, so that after printing, the unwanted portions of the web may be torn away to leave only the printed piece (e.g. an $8\frac{1}{2}\times 11$ inch "letter").

One important shortcoming with webs of the above-mentioned type is that no matter how well printed they may be, the fact that the material upon which the message is printed must be separated from the surrounding material by score lines makes it impossible for the final product to have the ideal appearance of an individually typed letter, on conventional stationery. The quality of the paper from which the web is formed is dictated at least in part by functional considerations, so the weight, texture and surface finish of the material is limited by the requirements of the printer. It is not economically practical to make the web from the wide variety of textured, tinted or water marked papers which can be used for quality business stationery, nor can the web have such desirable features as engraved letterhead. Thus, although webs of the above-described kind do facilitate fairly rapid printing on an automated and continuous basis, they do not produce a product which, under scrutiny, can give the appearance of an individually typed letter.

It is, therefore, a principal object of this invention to provide an apparatus which, in association with a printer, cheaply and reliably facilitates the automated printing of individual letters on conventional stationery.

An important aspect of this invention is that the apparatus can be reused numerous times.

SUMMARY OF THE INVENTION

The foregoing and other objects are realized, in a presently preferred form of the invention, by using, in association with a printer, a carrier for the work to be printed, the carrier consisting of a web which has a series of panels, connected in edge-to-edge relationship and folded in accordion fashion like conventional computer paper or forms. The panels, however, have on them means by which "work" to be printed, typically stationery, may removably be secured to the panels. In one form of the invention, the work securing means are so arranged that they accommodate stationery of a conventional size, such as $8\frac{1}{2}\times 11$ inch (letter) size, but other sizes could also be accommodated. Thus, stationery may be coupled to the panels for printing, and readily removed when the web has advanced through the printer and the printing is completed.

In one presently preferred form of the invention, the work securing members are spaced openings in the web, so oriented and arranged as to receive the corners of the work. Additional tabs and flaps are provided to stabilize the work, and to assure that it is securely coupled to the web.

In using the present invention, one can simply "load" the carrier with the stationery to be printed, and then arrange for feeding of the carrier through a microcomputer printer in a conventional manner. The printer can position in turn and print each successive work piece, advancing the carrier to the next panel and work piece when printing at one panel is completed. Thus, a preloaded carrier may be processed automatically, without manual intervention, in a large number of operations. When printing has been completed, the work pieces may he removed from the carrier and further processed for mailing or otherwise. Alternatively, completed work may be removed from the carrier without removing other work pieces still to be processed.

There are seen in the drawings forms of the invention which are presently preferred (and which represent the best mode contemplated for carrying the invention into effect), but it should be understood that the invention is not limited to the precise arrangements and instrumentalities shown.

BRIEF DESCRIPTION OF THE DRAWINGS

FIG. 1 is a perspective view showing apparatus in accordance with the invention.

FIG. 2 is a perspective view showing another embodiment of apparatus in accordance with the invention.

FIG. 3 is a plan view showing one panel of a carrier in accordance with the invention.

FIG. 4 is a partial cross-sectional view, taken along the line 4—4 in FIG. 2.

FIG. 5 is a perspective view, on a reduced scale, illustrating the manner in which work may be coupled to a carrier in accordance with the invention.

FIG. 6 is a partial view showing a detail of the embodiment of the invention shown in FIGS. 1 and 3.

FIG. 7 is a partial cross-sectional view, taken along the line 7—7 in FIG. 6, and showing the apparatus at an intermediate stage during coupling of work to a carrier.

DETAILED DESCRIPTION

Referring now to the drawings in detail, wherein like reference numerals indicate like elements, there is seen in FIG. 2 a carrier, designated generally by the reference numeral 10, for work to be printed. The carrier 10 comprises a continuous web 12, made up of a series of panels 14, connected edge-to-edge at fold lines 16. The web 12 may be folded and stored in accordion fashion, with adjacent panels 14 stacked one on top of the other.

Sprocket openings 18 may be provided along the edges of web 12, to facilitate engagement with the sprocket drive of a typical printer of the kind used with microcomputers, for advancement of the web 12 through the printer.

Means are provided on the panels 14 for securing work to the panels. In this regard, the panels 14 are provided with openings 20, 22, 24 and 26, so oriented and arranged as to receive and retain respective corners of a work piece, such as a cut sheet of stationery 28. The openings 20, 22, 24 and 26 may be slits, but preferably are open slots, from which material of the web 12 has been removed to create a gap 30 in the panel. Such openings facilitate coupling of the work piece to the web 12. Thus, in the illustrative form of the invention, the openings 20 and 22 are spaced in a widthwise direction with respect to the web 12 by a distance such that the upper corners of a standard letter-sized sheet can enter and be retained within the openings 20 and 22, with the stationery flat against the panel 14. The openings 24 and 26 are similarly spaced from each other and are spaced, respectively, from the openings 20 and 22 by a distance corresponding to the length of the stationery 28. Thus, for a panel 14 intended for use with letter sized stationery, the openings 20 and 24 and the openings 22 and 26 will be spaced apart by a distance of approximately 11 inches. The openings 20–26 are oriented on a bias with respect to the lateral edges of the web 12 and the fold lines 16 which separate the panels 14, and are preferably spaced from the fold lines 16.

Coupling of the work (the stationery 28) to the panel 14 is also enhanced by forming from the web 12 tabs 32, so positioned that they can be made to overlie edges of the stationery 28 when the corners of the stationery 28 are received in the openings 20–26. The tabs 32 are preferably formed by making V-shaped perforations through the material of the web 12. As in the case of the openings 20–26, material may be removed from the web 12 (to create a gap 34), to facilitate the desired coupling of the work piece to the web 12. When the stationery 28 is coupled to the web 12, the tabs 34 may be manipulated to overlie an edge of the stationery 28. In the embodiment of the carrier 10 shown in FIG. 1, two tabs 34 are disposed between the openings 20 and 22, for engagement with the top, or leading, edge of the stationery 28 to ensure a smooth entry into the printer mechanism. The combined effect of the engagement of the corners of the stationery 28 with the various openings 20–26 and the tabs 32 overlying the edges of the stationery 28 is to maintain the stationery in close engagement with the surface of the web 12, so that as the web 12 advances, the stationery 28 also advances without relative movement between the web 12 and the stationery 28.

Referring now to FIGS. 1 and 3, there is seen a presently preferred form of the invention wherein elements corresponding to those previously described are designated by like primed (') reference numerals.

The carrier 10' of FIGS. 1 and 3 comprises a web 12', which is provided with openings 20', 22', 24' and 26', and tabs 32', so positioned and arranged as to allow for coupling to the panel 14' of the web 12' of work, such as the stationery 28'.

The carrier 10' is provided with flaps 36 and 38, distal portions 40, 42 of which project inwardly with respect to the lateral edges of the web 12'. The distal portions 40, 42 of the flaps 36 and 38 are adapted to engage and overlie lateral edges of the work, such as the illustrated stationery 28' when the stationery 28' is coupled to the web 12'.

The flaps 36 and 38 may be described as elongated in the direction of the web 12, and they preferably serve to maintain a substantial length of the edge of the work (stationery 28') in the plane of the panel 14' when the carrier 10' is used.

In their preferred form, the flaps 36 and 38 are defined by slits or perforations through the web 12', the shape or profile of which will now be described by reference to the slit or perforation 44 best seen in FIG. 6. The profile of the slit or perforation 44 comprises a first segment 46, which extends in a direction obliquely inwardly and downstream with respect to the lateral edge of the web 12' and a second segment 48 which extends in a direction inwardly and upstream with respect to the lateral edge of the web 12. A transitional segment 50 interconnects the first and second segments 46 and 48, with adjacent segments preferably being faired into each other by smoothly contoured corner portions 52 and 54. For reasons explained below, the transitional segment 50 is itself preferably obliquely disposed with respect to the lateral edges of the web 12', so that it extends obliquely inwardly with respect to the lateral edge in a direction downstream with respect to the web 14'. In a flap 36 or 38 thus configured, the downstream corner portion (such as the corner portion 54) is spaced from the lateral edge of the web 12' by a distance slightly greater than is the corner portion 52.

The segments 46 and 48 are provided at their ends, in the presently preferred form of the invention, with respective end segments 56 and 58, the terminal ends 60 and 62 of which are directed away from the lateral edge of the web. The end segments 56 and 58 preferably have an arcuate shape, as depicted in FIG. 6.

The above-described configuration of the flaps 36 and 38 facilitates joining of the work and the carrier 10 in a manner illustrated in the detail view which is FIG. 7.

In loading the web 12', after first engaging the corners of the stationery 28' with the openings 20', 22', 24' and 26', the user may readily grasp the respective opposite edges of the web 12' at locations adjacent to the flaps 36 and 38. Referring to FIGS. 6 and 7, the flaps 36 and 38 may readily be made to overlie lateral edges of the stationery 28' by grasping the lateral edges of the web 12' in such a manner that the thumbs of the user contact the upper surface of the web 12' at a location approximating the location "A" in FIG. 6, and the tips of the fingers of the user contact the underside of the web 12' in the area of the flaps 36 and 38 at a location approximating the location "B". Referring now to FIG. 7, application of an upwardly directed force in the direction of the arrow $F_B$ while maintaining as a fulcrum thumb contact and downward force in the direction of the arrow $F_A$ causes the flap 28 to rotate out of the plane of the panel 14' and to snap over the lateral edge of the stationery 28'. Release of the web 12' leaves the flaps 36 and 38 in the positions with respect to the lateral edges of the stationery, 28' seen in full lines in FIGS. 1, 5 and 6 and in dotted lines in FIG. 3. Before or after arranging the flap members 36 and 38 as described above, the leading edge of the stationery 28' may be placed beneath tabs 32'.

The above-described preferred profile of the flaps 36 and 38 has been found particularly advantageous in that it facilitates repeated use of the carrier 10' by minimizing tearing of the web 12' during loading of the work and passage of the carrier 10' through a microcomputer printer. Referring again to FIG. 6, it will be seen that, unlike the situation which would exist if the segments 46 and 48 were not provided with the end segments 56 and 58, the lateral edge of the stationery 28' bears not against the relatively weak extreme terminal ends 60 and 62 associated with the end segments 56 and 58, but rather, against elongated stress-accommodating side walls "S". The side wells "S" extend, in the areas of contact with the lateral edge of the stationery 28' generally parallel to that edge. In this fashion, local stress on the web 12', which might otherwise cause the web 12' to tear, is distributed, so that the tear strength of the web 12 is not exceeded. The above-described contour of the flaps 36 and 38, in which the downstream parts of the distal portions 40 and 42 (adjacent to the downstream corner portion 54) is further from the edge of the web 12' than the upstream part, also facilitates smooth passage of the flaps 36 and 38 through the printer, and in that manner also tends to minimize wear and tear on the web 12'.

The manner in which the present apparatus may be used should now be apparent. A cut sheet of blank paper or letterhead may be mounted on each panel 14, 14', and the web 12, 12' permitted to advance line-by-line through the printer. As each panel 14, 14' advances, the desired characters are applied as directed by the controlling computer. Depending upon the nature of the computer and the printer, printing may be accomplished at rates up to 500 words per minute. In accordance with the program, successive documents may differ in predetermined and desired respects. For example, messages identical in form may be addressed to an address list, appropriate addresses being applied to successive work pieces. Alternatively, different messages may be applied to the stationery on the different panels.

The webs 12, 12' are not intended do be discarded after each printing run. Rather, they are intended to be refolded, reloaded and reused. The paper from which the webs 12, 12' are made must of course be of somewhat greater weight and quality than conventional computer paper, but various weights of paper are suitable. In one present application, 40 pound rag paper is adequate.

The various openings 20–26, etc., and tabs 34 and flaps 36 and 38 may be formed in any conventional and convenient manner, such as by die cutting. The carrier 10, 10' may conveniently be sold as computer paper is sold, in pre-packaged lengths of 20 to 50 panels, although other suitable arrangements are of course possible and may be desirable in particular instances.

The present invention may be embodied in other specific forms without departing from its spirit or essential attributes. Accordingly, reference should be made to the appended claims rather than the foregoing specification, as indicating the scope of the invention.

I claim:

1. For use in association with a microcomputer printer, a ready-made reusable carrier for work to be printed, comprising: a web so dimensioned as to be adapted for insertion into and movement through a microcomputer printer, said web having a plurality of panels connected in edge-to-edge and defined by fold lines extending transversely across said web and work securing means associated with said panels whereby work to be printed can manually be temporarily coupled to said panels before insertion of said web into the printer and removed from said web without destruction of said web after printing, said work securing means comprising a plurality of ready-made openings in said panels, said openings being positioned and arranged on said panels in correspondence with the dimensions of the work with which the carrier is intended to be used and so disposed on said panels as to be adapted to receive and retain respective corners of the work; said work securing means further comprising edge-constraining members cut from said web, said edge-constraining members comprising flap members elongated in the direction of said web and having distal portions thereof projecting tranaversely inwardly with respect to the lateral edges of said web and adapted to engage and overlie lateral edges of the work, said flap members being defined by perforations of said web which comprise a first segment extending in a direction downstream with respect to said web and angled obliquely inwardly with respect to the lateral edge of said web, a aecond segment extending in a direction upstream with respect to said web and angled obliquely inwardly with respect to the lateral edge of said web, and a transitional segment elongated in the direction of said web and interconnecting said first and said second segment, said transitional segment extending obliquely inwardly respect to the lateral edge of said web in direction downstream with respect to said web.

2. A reuseable carrier in accordance with claim 1, wherein the intersections of said first and second segments and said transitional segments comprise faired corner portions.

3. A reuseable carrier in accordance with claim 2, and said first and second segments of said perforations having hooked end segments thereof, said end segments having terminal ends directed away from the lateral edges of said web.

4. A reuseable carrier in accordance with claim 3, wherein said end segments have an arcuate configuration.

5. For use in association with a microcomputer printer, a ready-made reuseable carrier for work to be printed, comprising a web so dimensioned as to be adapted for insertion into and movement through a microcomputer printer, said web having a plurality of panels connected in edge-to-edge relation and defined by fold lines extending transversely across said web, and work securing means associated with said panels whereby work to be printed can manually temporarily be coupled to said panels before insertion of said web into the printer and removed from said web without destruction of said web after printing, said work securing means comprising a plurality of ready-made openings in said panels spaced from said fold lines, said openings being positioned and arranged on said panels in correspondence with the dimensions of the work with which the carrier is intended to be used, said work securing means further comprising edge-constraining members cut from said web, said edge-constraining members comprising tab members so oriented and arranged as to engage and overlie at least the leading edge of the work, said edge-constraining members further comprising flap members elongated in the direction of said web and having distal portions thereof projecting transversely inwardly with respect to the lateral edges of said web and adapted to engage and overlie lateral edges of the work, said flap members having an edge thereof elongated in the direction of said web and extending obliquely inwardly with respect to the lateral edge of the web so that downstream parts of said distal portions of said flap members project transversely inwardly for greater distances than the upstream parts of said flap members.

6. A reuseable carrier in accordance with claim 5, wherein said flap members are defined by perforations of said web, said perforations comprising a first segment extending in a direction downstream with respect to said web and obliquely inwardly with respect to the lateral edge of said web, a second segment extending in a direction upstream with respect to said web and obliquely inwardly with respect to the lateral edge of said web, and a transitional segment interconnecting said first and said second segments.

7. A reuseable carrier in accordance with claim 6, wherein the intersections of said first and second segments and said transitional segment comprise faired corner portions.

8. A reuseable carrier in accordance with claim 7, and said first and second segments of said perforations having hooked end segments thereof, said end segments having terminal ends directed away from the lateral edges of said web.

9. A reuseable carrier in accordance with claim 8, wherein said end segments have an arcuate configuration.

* * * * *